US008510912B2

(12) United States Patent
Tarrega Lloret

(10) Patent No.: US 8,510,912 B2
(45) Date of Patent: Aug. 20, 2013

(54) SELF-CLOSING DEVICE FOR SLIDING DOORS

(75) Inventor: Miguel Angel Tarrega Lloret, Barcelona (ES)

(73) Assignee: Klein Iberica, S.A., Barcelona (ES)

( * ) Notice: Subject to any disclaimer, the term of this patent is extended or adjusted under 35 U.S.C. 154(b) by 69 days.

(21) Appl. No.: 13/207,162

(22) Filed: Aug. 10, 2011

(65) Prior Publication Data

US 2012/0285093 A1 Nov. 15, 2012

Related U.S. Application Data

(60) Provisional application No. 61/485,489, filed on May 12, 2011.

(51) Int. Cl.
*E05F 1/08* (2006.01)
*E05F 3/00* (2006.01)

(52) U.S. Cl.
USPC ..... 16/79; 16/63; 16/71; 16/78

(58) Field of Classification Search
USPC ..... 16/63, 64, 75–78, 193, 197, 198; 49/379, 360, 381, 386, 394, 404, 405, 449; 160/191, 192, 290.1, 322
See application file for complete search history.

(56) References Cited

U.S. PATENT DOCUMENTS

| | | | | | |
|---|---|---|---|---|---|
| 4,330,960 | A * | 5/1982 | Hasemann et al. | 49/404 |
| 4,375,019 | A * | 2/1983 | Yoshida | 200/52 R |
| 4,675,938 | A * | 6/1987 | Bundschuh | 16/63 |
| 4,738,052 | A * | 4/1988 | Yoshida | 49/31 |
| 5,247,763 | A * | 9/1993 | Hein | 49/31 |
| 5,755,060 | A * | 5/1998 | Zweili | 49/449 |
| 5,937,478 | A * | 8/1999 | Regnier | 16/78 |
| 6,021,607 | A * | 2/2000 | Angove | 49/404 |
| 6,990,771 | B2 * | 1/2006 | Pfaff | 49/94 |
| 7,124,469 | B2 * | 10/2006 | Tsekhanovsky et al. | 16/79 |
| 7,246,688 | B2 * | 7/2007 | Tonna et al. | 187/324 |
| 7,992,346 | B2 * | 8/2011 | Finke | 49/123 |

* cited by examiner

*Primary Examiner* — Chuck Y. Mah
(74) *Attorney, Agent, or Firm* — Merchant & Gould P.C.

(57) ABSTRACT

A self-closing device is for sliding doors of the type including at least one sliding leaf (2) which is hung from an upper profile (3). The device (1) includes a drive belt (10) configured to be joined to the sliding leaf (2); a closing pulley (20), provided with an elastic device (30), which is arranged on a first rotation axis (4) integral to the upper profile (3) and which engages with a first end (11) of the drive belt (10); and a brake pulley (40), provided with a stop (50), which is arranged on a second rotation axis (5) integral to the upper profile (3) and which engages with a second end (12) of the drive belt (10) opposite to the first end (11). The rotation movement of both pulleys (20, 40) is connected by the drive belt (10).

10 Claims, 7 Drawing Sheets

SELF-CLOSING DEVICE FOR SLIDING DOORS

This application claims benefit of U.S. Provisional Ser. No. 61/485,489, filed 12 May 2011 and which application is incorporated herein by reference. To the extent appropriate, a claim of priority is made to the above disclosed application.

OBJECT OF THE INVENTION

The present invention refers to a self-closing device for sliding doors, of the type comprising at least one sliding leaf which is hung from an upper profile and which is configured to displace in the direction thereof. Where said device enables the sliding leaf to close autonomously, at a constant speed adjusted at the users will. The closing movement is performed in a secure, efficient, smooth and stable manner, avoiding undesired noises and slum shuts. The device of the present invention has in turn a reduced and compact size that facilitates mounting and maintenance tasks.

The present invention is especially suitable for its use in sliding doors which have sliding leaves manufactured using any type of material, such as glass, wood, plastic or combinations thereof, and admits a great variety of construction variants.

BACKGROUND OF THE INVENTION

The sliding doors that close autonomously are of great interest, especially in the domestic and commercial areas, for energy efficiency reasons. The use thereof in any type of air-conditioned enclosure or space enables, for example, to significantly reduce the energy consumption intended for the thermal adaptation thereof.

Nowadays, there are known different types of devices, more or less complex, which enable to perform the autonomous closing of sliding doors in a more or less efficient manner.

Among the most simple ones, we can highlight the devices using one or more coil springs arranged longitudinally in the direction of the upper profile, where one of the ends is extended pushed by a drag mechanism integral to the sliding leaf during the opening thereof. Once the sliding leaf is released, it is pushed in the closing direction by the spring, which tends to recover its resting state. Generally, these devices are combined with the use of a cylinder-piston that serves to damp the closing. This type of devices has several problems. The first one of them is that, once the spring is selected and the device is installed there is no possibility of adjusting the closing speed. The second problem is that the closing does not occur at constant speed, that is, the sliding leaf is initially accelerated and then slows down producing sudden movements which can produce clashes, dangerous situations and swinging movements which can produce vibrations. The third problem is that, with time the spring starts to lose elastic strength until being insufficient to produce the complete closing of the door.

Among the most complex closing devices we can highlight those that use a cable featuring an end joined to the sliding leaf, while the other end is related to a spring. The operation mode related to the door closing is equivalent to the previous case, during the opening of the sliding leaf the cable is extended tightening the spring, and once the sliding leaf is released the spring is loosen and pulls from the cable to drag it. The operation mode related to the stop of the sliding leaf does have considerable differences compared to the previous case. More specifically, this type of devices requires the use of external stops which are arranged on some fixed point of the door. Among the different possibilities there are highlighted the use of elements that act as stops or rack-sections arranged near the side where the door is closed. In the case of racks, they are generally configured to receive a toothed pulley arranged on the sliding leaf. Once the toothed pulley is engaged with the rack the movement of the sliding leaf slows down. This type of devices has problems similar to the preceding case. That is, there is no possibility of adjusting the closing speed, said closing does not occur at constant speed and also sudden acceleration and deceleration events occur that can deteriorate or break elements of the device or the door, or even cause accidents. Besides these problems, there are mounting difficulties produced by the fact that there is an external stop to attain a correct adjustment.

In order to solve the aforementioned problems, the self-closing device for sliding doors of the present invention has an efficient and secure design that allows the closing of the sliding leaf at an adjusted constant speed at the users will, while having a reduced and compact size which facilitates mounting and maintenance tasks.

SUMMARY OF THE INVENTION

The device of the present invention is especially designed for sliding doors comprising at least one sliding leaf which is hung from an upper profile and which is configured to displace in the direction thereof. In this sense, the construction variants accepted by this type of doors are very diverse, beyond the materials that form them and their arrangement with respect to the adjacent enclosures. To name a few examples, the device of the present invention can be applied in sliding doors with one or more sliding leaves that move simultaneously in the same direction or in opposite directions.

In order to solve the aforementioned problems, the device of the present invention comprises:

- a drive belt arranged along the upper profile and configured to be joined to the sliding leaf;
- a closing pulley, provided with elastic means, that is arranged on a first rotation axis integral to the upper profile and that engages with a first end of the drive belt, where said pulley is configured to:
  - load the elastic means during the opening of the sliding leaf through the rotation movement transmitted by the drive belt; and to
  - push the sliding leaf during the closing thereof through the rotation movement in the opposite direction that transmits the unloading of the elastic means;

and;

- a brake pulley, provided with stopping means, which is arranged on a second rotation axis integral to the upper profile and which engages with a second end of the drive belt opposite to the first end, the rotation movement of both pulleys being connected by the drive belt, where said brake pulley is configured to:
  - disengage the stopping means during the opening of a sliding leaf; and to
  - stop the sliding leaf during the closing thereof by means of the clutch of the stopping means.

The connection of the closing and brake pulleys through the drive belt enables the closing movement of the sliding leaf at a constant speed, which can also be adjusted by the user, as it will be described below. Such adjustment is considered optimum, for example, when the sliding leaf completes the closing in an appropriate manner and stops without producing damages when there is an obstacle or a person interrupting its forward movement, later completing the closing once the obstacle is removed or the person moves away.

The drive belt is joined to a connection skid integral to a traction clamp that fastens the sliding leaf, where said traction clamp comprises rolling means configured to be displaced on a rolling rail arranged along the upper profile. Generally, the sliding leaf is also attached to a dragging clamp, which is not engaged to the drive belt, where said dragging clamp comprises rolling means configured to displace on the rolling rail. Preferably, the drive belt is vertically arranged on the upper profile, for space optimization reasons. However, if the mounting requires it, the drive belt, together with the rest of the device components, can also be arranged in horizontal position with respect to said upper profile.

The closing pulley comprises:

- a closing body, joined to the first rotation axis by means of a first bearing, that has an inner housing configured to house the elastic means; and
- a closing cap, joined to the first rotation axis through a second bearing, that has first fixing means to the closing body to contain the elastic means.

The closing body of the closing pulley comprises a first toothed perimeter configured to engage with the drive belt.

The closing pulley additionally comprises a pair of washers arranged between the elastic means, within the inner housing, where said washers enable to contain the axial efforts caused by said elastic means when they operate.

Preferably, the elastic means comprise a leaf spring featuring an inner end joined to a first rotation axis and an outer end joined to the closing body, where said leaf spring is compressed during the opening of the sliding leaf and decompressed during the closing thereof. The leaf spring is selected according to the weight of the door sliding leaves, so that it has enough strength to push them at the desired speed. Likewise, the prestressing of the leaf spring is adjusted so that, once the sliding leaf is closed, it maintains a minimum amount of accumulated energy. Thus, the appropriate closing of the sliding leaf is guaranteed, preventing its stop before it is completely closed, and installation tasks are facilitated, since it is possible to correct mounting dimensional errors produced by the inaccurate positioning of the device elements.

The brake pulley comprises:

- a stop body, joined to the second rotation axis by means of a third bearing, that has an inner housing configured to house the stopping means; and
- a brake cap that has second fastening means to the stop body to contain the stopping means.

The stop body comprises a second toothed perimeter configured to engage with the drive belt.

Preferably, the stopping means comprise:

- a friction brake drum, joined to the stop body by means of third fastening means; and
- a brake shaft, joined to the second rotation axis by means of a unidirectional bearing, which is freely coupled to the brake drum, where said unidirectional bearing is configured to:
  - allow the rotation movement of the brake shaft during the opening of the sliding leaf, so that said axis rotates at the same speed and in the same direction as the brake drum, preventing any friction between them; and
  - block the rotation movement of the brake shaft in the opposite direction during the closing of the sliding leaf, so that said axis does not move and produces friction against the brake drum.

The stopping means comprise a friction adjuster coupled to the brake drum, which is configured to control the level of friction between the brake shaft and the brake drum. This adjustment enables to adjust the closing speed of the sliding leaf.

The device of the present invention is complemented by two lateral protection elements. The first one of them consists of a damper protection element, while the second one consists of a retaining protection element.

The damper protection element is configured to soften the closing of the sliding leaf at the last part, that is, at the time when it completes the closing position. The damper protection element is fixed to the upper profile to softly stop the final advance of the traction clamp, contact which is attained through a rubber piece or a piece of any other elastic material.

The retaining protection element fulfils a double function: it softens the opening of the sliding leaf at the last part, that is, at the time when it completes the opening position, and retains the sliding leaf if it is desired to maintain the door completely open for an indefinite period of time. In order to fulfil the damping function, the retaining protection element is fixed to the upper profile to softly stop the final advance of the dragging clamp, contact which is attained through a rubber piece or a piece of any other elastic material. In order to fulfil this retention function, the retaining protection element comprises a hitch plate with a joint configured to receive and retain a hitch screw arranged in the dragging clamp.

BRIEF DESCRIPTION OF THE DRAWINGS

The following is a brief description of a series of drawings which will help understand the invention better relating to an embodiment of said invention which is presented as a non-limiting example thereof.

DETAILED DESCRIPTION OF THE PREFERRED EMBODIMENT(S)

Figure 1:
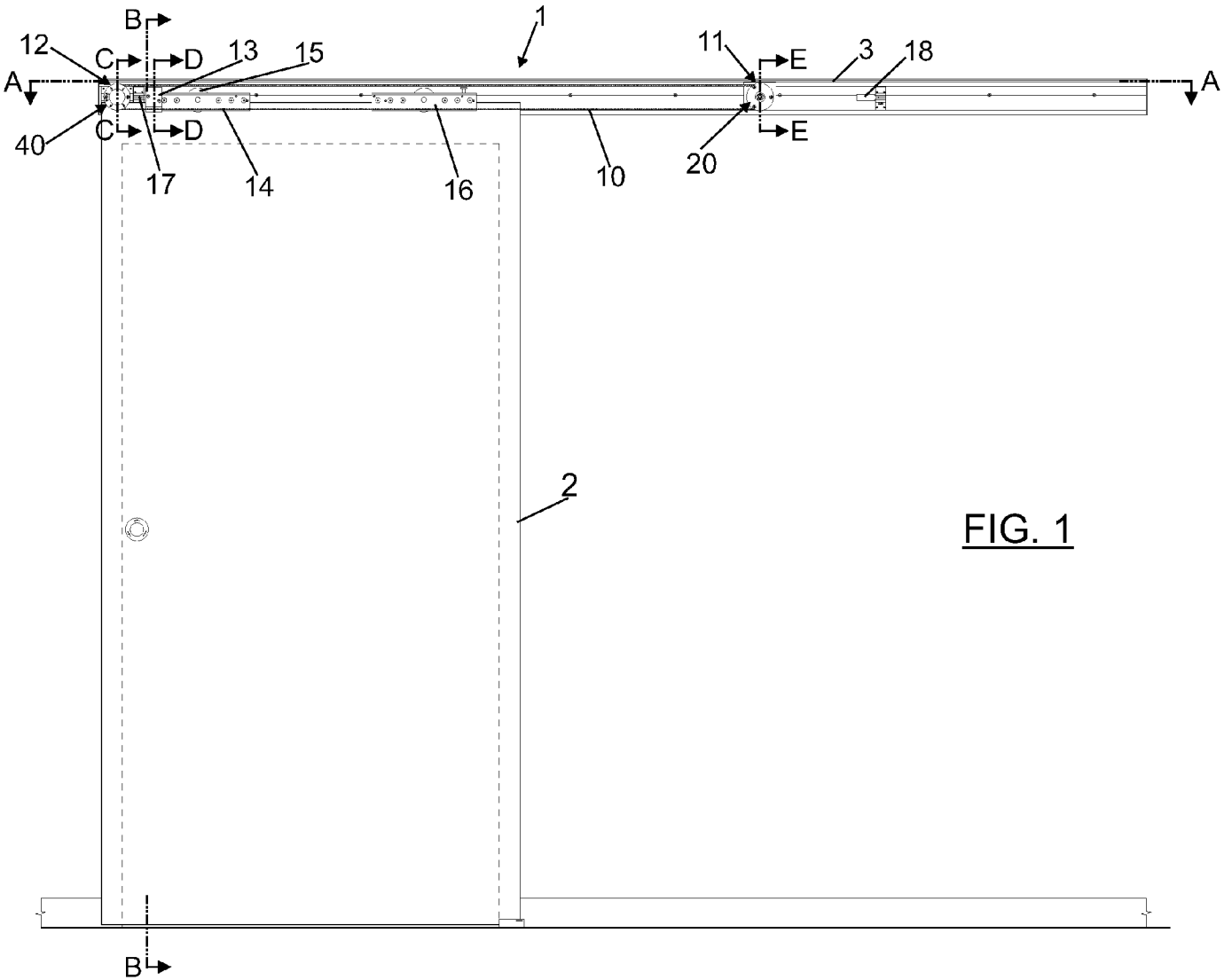
FIG. 1 shows an elevation view of the device of the present invention applied to a sliding door of a leaf.

FIG. 1 shows an elevation view of the device (1) of the present invention applied to a sliding door comprising a sliding leaf (2) which is hung from an upper profile (3) and which is configured to displace in the direction thereof. The door is represented with the sliding leaf (2) in the closed position.

Figure 6:
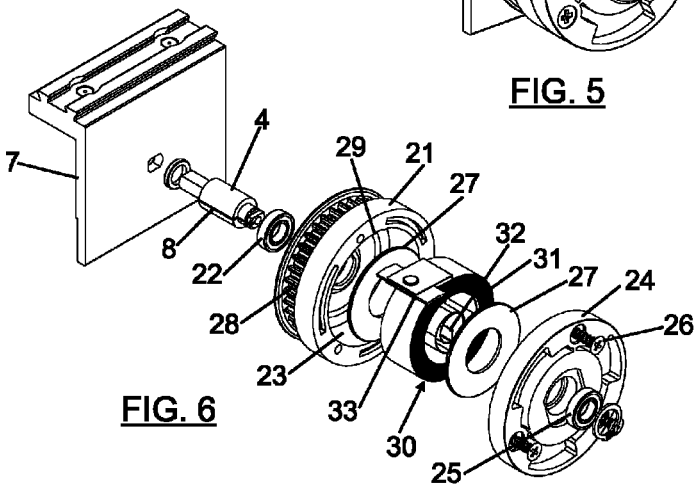
FIG. 6 is an exploded view of the closing pulley.
Figure 8:
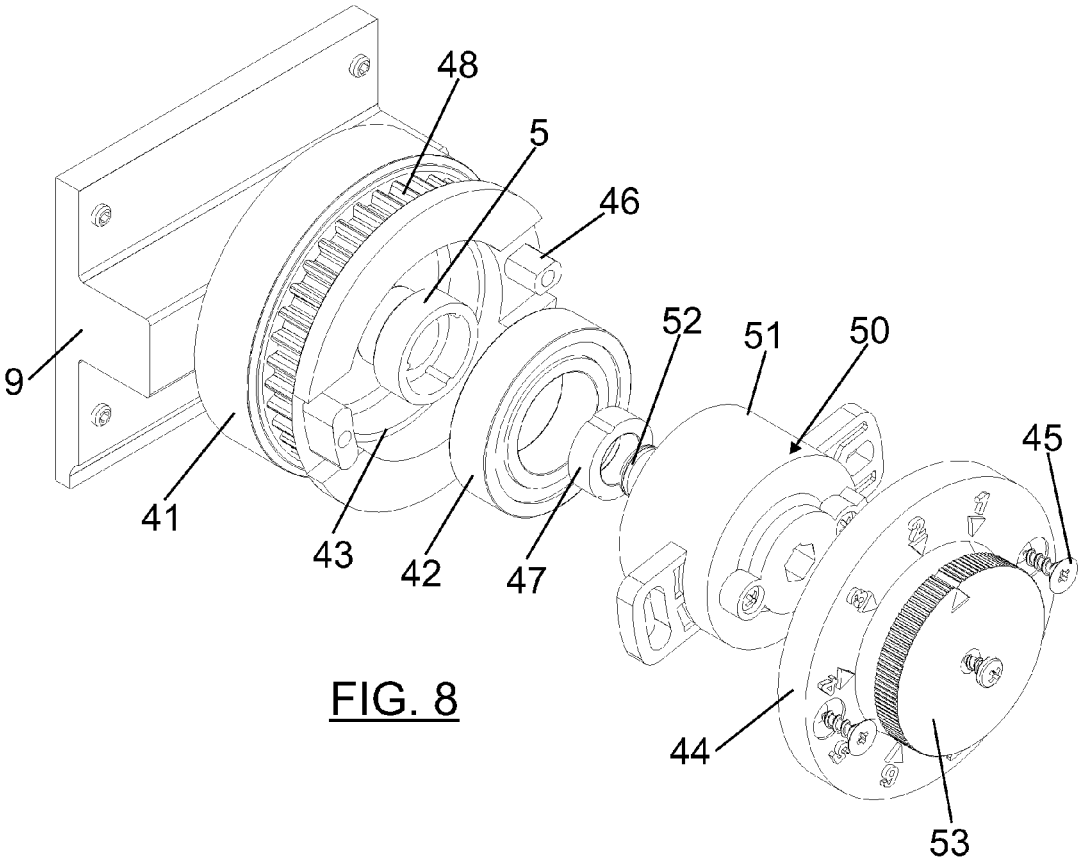
FIG. 8 is an exploded view of the brake pulley.
Figure 9:
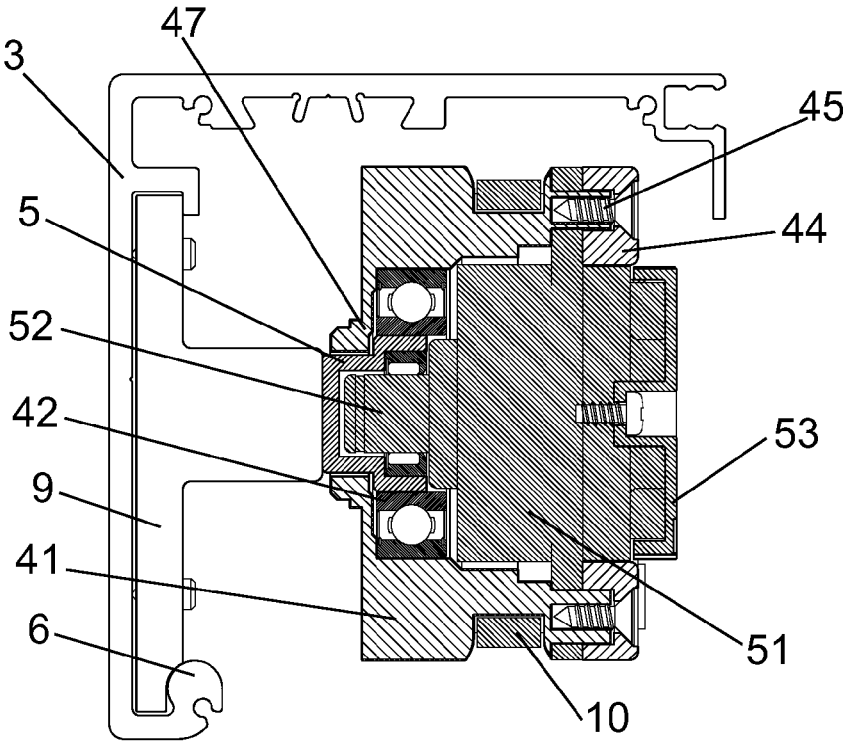
FIG. 9 corresponds to section C-C of FIG. 1.
Figure 11:
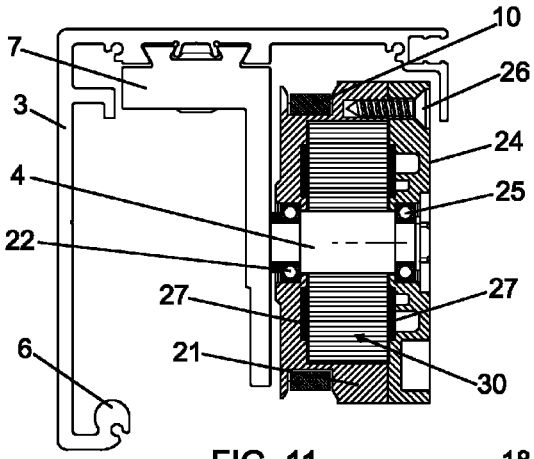
FIG. 11 corresponds to section E-E of FIG. 1.

As it can be seen, the device (1) comprises:

- a drive belt (10) arranged along the upper profile (3) and configured to be joined to the sliding leaf (2);
- a closing pulley (20), provided with elastic means (30), that is arranged on a first rotation axis (4) integral to the upper profile (3), FIGS. 6 and 11, and that engages with a first end (11) of the drive belt (10), where said pulley (20) is configured to:

load the elastic means (30) during the opening of the sliding leaf (2) through the rotation movement transmitted by the drive belt (10); and to push the sliding leaf (2) during the closing thereof through the rotation movement in the opposite direction that transmits the unloading of the elastic means (30);

and;

a brake pulley (40), provided with stopping means (50), which is arranged on a second rotation axis (5) integral to the upper profile (3), FIGS. 8 and 9, and which engages with a second end (12) of the drive belt (10) opposite to the first end (11), the rotation movement of both pulleys (20, 40) being connected by the drive belt (10), where said brake pulley (40) is configured to:

disengage the stopping means (50) during the opening of a sliding leaf (2); and to stop the sliding leaf (2) during the closing thereof by means of the clutch of the stopping means (50).

The relation of the closing (20) and brake pulleys (40) through the drive belt (10) enables the closing movement of the sliding leaf (2) at a constant speed.

Figure 2:
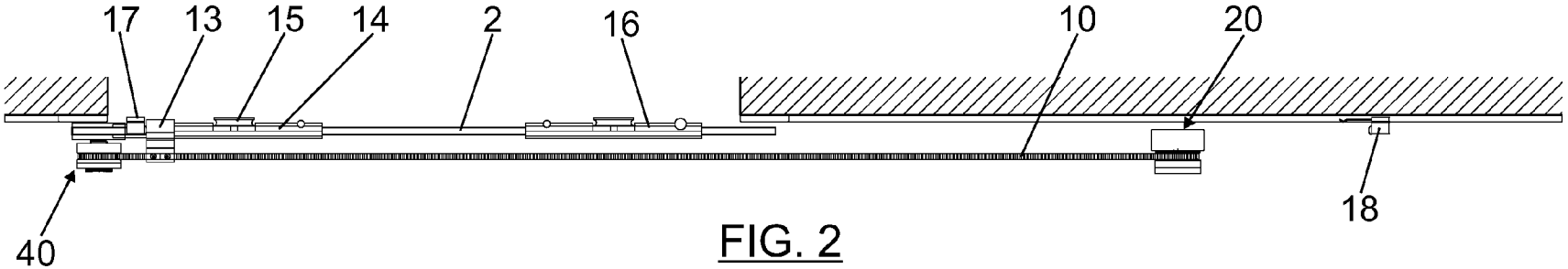
FIG. 2 corresponds to section A-A of FIG. 1.
Figure 3:
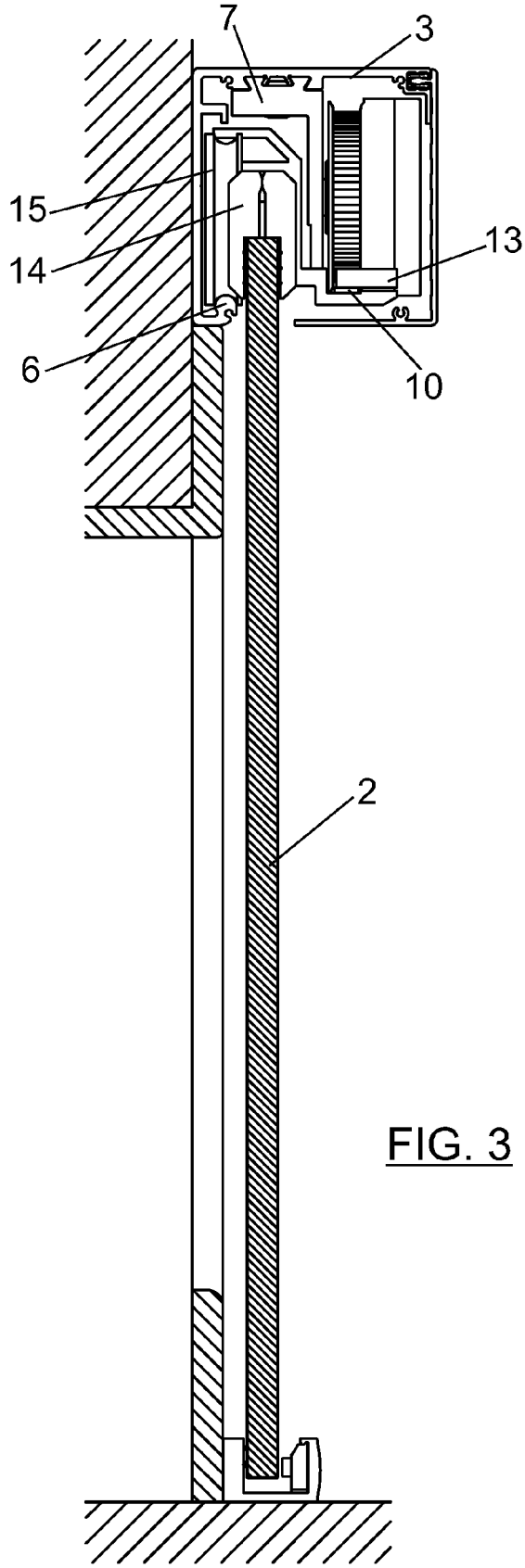
FIG. 3 corresponds to section B-B of FIG. 1.

FIGS. 2 and 3 show that the drive belt (10) is joined to a connection skid (13) integral to a traction clamp (14) that fastens the sliding leaf (2), where said traction clamp (14) comprises rolling means (15) configured to be displaced on a rolling rail (6) arranged along the upper profile (3). The sliding leaf (2) is also attached to a dragging clamp (16), which is not engaged to the drive belt (10), where said dragging clamp (16) comprises rolling means (15) configured to displace on the rolling rail (6). In the present embodiment example, the drive belt (10) is arranged vertically on the upper profile (3).

Figure 4:
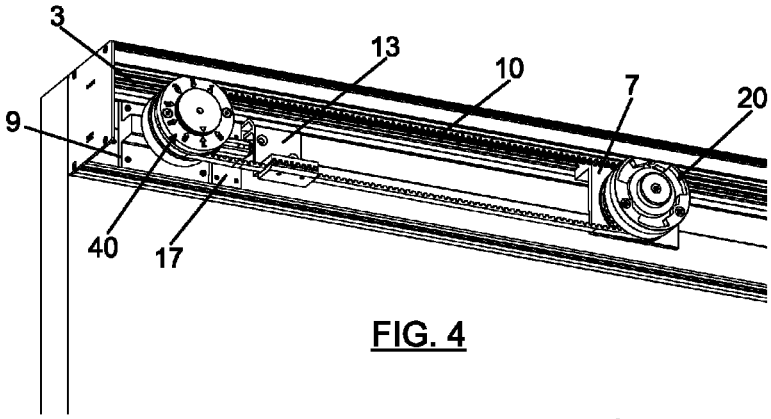
FIG. 4 is a perspective view of the device of the present invention.

FIG. 4 is a perspective view of the device (1) where it can be seen in greater detail the arrangement of the components thereof in relation to the upper profile (3).

Figure 5:
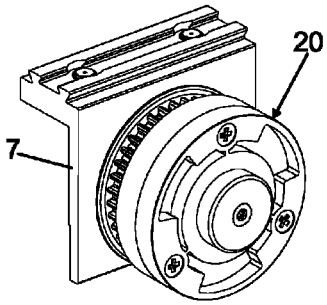
FIG. 5 is a perspective view of the closing pulley.

FIG. 5 is a perspective view of the closing pulley (20) mounted on a first support plate (7) which enables its fastening to the upper profile (3).

FIG. 6 is an exploded view of the closing pulley (20), where it can be seen that it comprises:

a closing body (21), joined to the first rotation axis (4) by means of a first bearing (22), that has an inner housing (23) configured to house the elastic means (30); and a closing cap (24), joined to the first rotation axis (4) through a second bearing (25), that has first fixing means (26) to the closing body (21) to contain the elastic means (30). The first fixing means (26) allow its mounting and dismounting for maintenance tasks, and to that end screws can be used, such as in the present example, or clips, snap elements or other fixing elements which are easy to use can be used in other configurations. The first (22) and second (25) bearing can rotate in both directions.

The closing body (21) of the closing pulley (20) comprises a first toothed perimeter (28) configured to engage with the drive belt (10).

The closing pulley (20) additionally comprises a pair of washers (27) arranged between the elastic means (30), within the inner housing (23), where said washers (27) allow to contain the axial efforts caused by said elastic means (30) when they operate.

Preferably, the elastic means (30) comprise a leaf spring (31) featuring an inner end (32) joined to the first rotation axis (4) and an outer end (33) joined to the closing body (21), where said leaf spring (31) is compressed during the opening of the sliding leaf (2) and decompressed during the closing thereof. The first rotation axis (4) comprises a notch (8) in which the inner end (32) is introduced to allow the joining between the first axis (4) and the leaf spring (31). The closing body (21) comprises a notch (29) in which the outer end (33) is fitted to allow the joining between the leaf spring (31) and the closing body (21).

Figure 7:
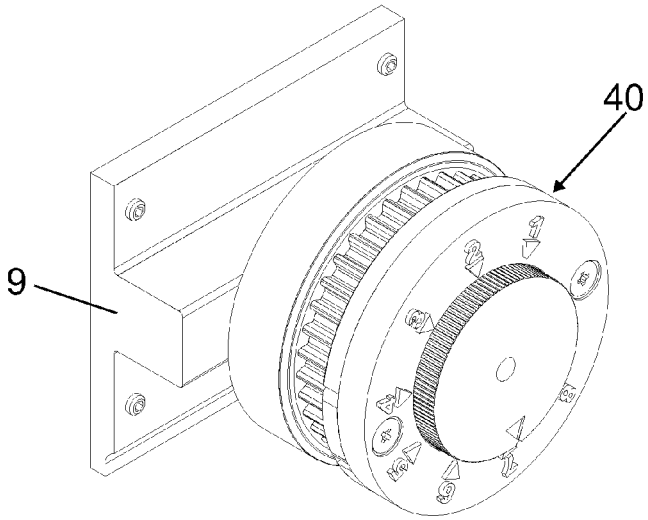
FIG. 7 is a perspective view of the brake pulley.

FIG. 7 is a perspective view of the brake pulley (40) mounted on a second support plate (9) which enables its fastening to the upper profile (3).

FIG. 8 is an exploded view of the brake pulley (40), where it can be seen that it comprises:

a stop body (41), joined to the second rotation axis (5) by means of a third bearing (42), that has an inner housing (43) configured to house the stopping means (50); and a brake cap (44) that has second fastening means (45) to the stop body (41) to contain the stopping means (50).

The stop body (41) comprises a second toothed perimeter (48) configured to engage with the drive belt (10).

Preferably, the stopping means (50) comprise:

a friction brake drum (51), joined to the stop body (41) by means of third fastening means (46); and a brake shaft (52), joined to the second rotation axis (5) by means of a unidirectional bearing (47), which is freely coupled to the brake drum (51), where said unidirectional bearing (47) is configured to:

allow the rotation movement of the brake shaft (52) during the opening of the sliding leaf (2), so that said axis (52) rotates at the same speed and in the same direction as the brake drum (51), preventing any friction between them; and block the rotation movement of the brake shaft (52) in the opposite direction during the closing of the sliding leaf (2), so that said axis (52) does not move and produces friction against the brake drum (51).

The second (45) and third fixing means (46) allow its mounting and dismounting for maintenance tasks, and to that end screws and couplings can be used, such as in the present example, or clips, snap elements or other fixing elements which are easy to use can be used in other configurations. The third bearing (42) can rotate in both directions.

The stopping means (50) comprise a friction adjuster (53) coupled to the brake drum (51), which is configured to control the level of friction between the brake shaft (52) and the brake drum (51).

Figure 10:
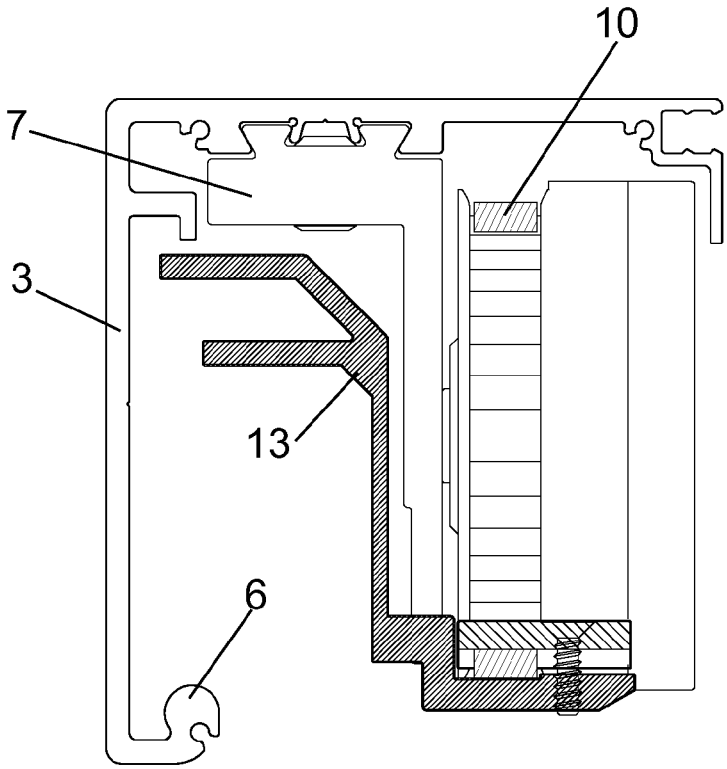
FIG. 10 corresponds to section D-D of FIG. 1.

In the sections of FIGS. 9, 10 and 11, it can be seen in greater detail how the different functional elements are integrated; brake pulley (40), drive belt (10) and closing pulley (20), respectively.

Figure 12:
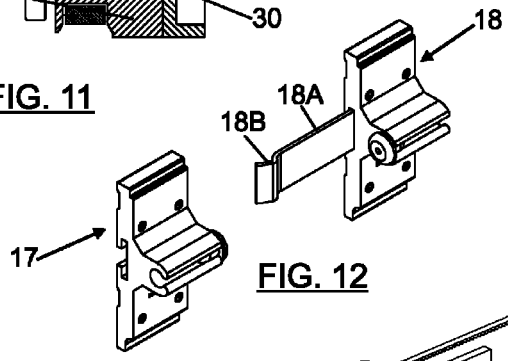
FIG. 12 is a perspective view of the lateral protection elements.

FIG. 12 shows a perspective view of the lateral protection elements; the damper protection element (17) and the retaining protection element (18).

The damper protection element (17) is configured to soften the closing of the sliding leaf (2) at the time when it completes the closing position. The damper protection element (17) is fixed to the upper profile (3), FIGS. 1 and 2, to softly stop the final advance of the traction clamp (14), contact which is attained through a rubber piece or a piece of any other elastic material.

Figure 13:
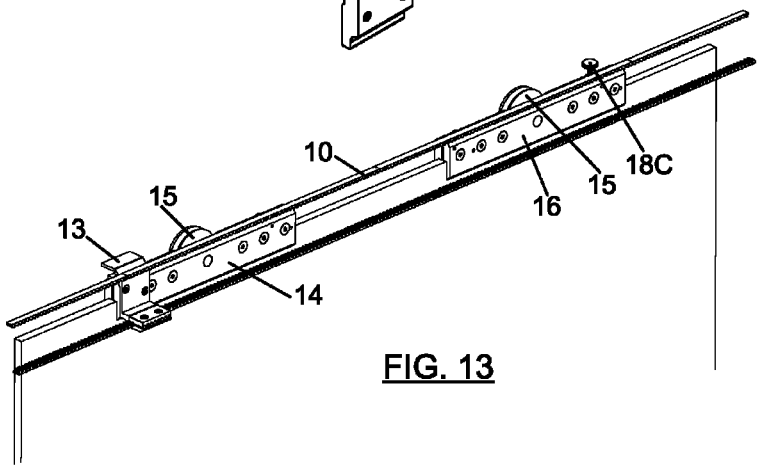
FIG. 13 is a perspective view of the drive belt.

The retaining protection element (18) fulfils a double function: it softens the opening of the sliding leaf (2) at the time when it completes the opening position, and retains the sliding leaf (2) if it is desired to maintain the door open. In order to fulfil the damping function, the retaining protection element (18) is fixed to the upper profile (3) to softly stop the final advance of the dragging clamp (16), contact which is attained through a rubber piece or a piece of any other elastic material. In order to fulfil this retention function, the retaining protection element (18) comprises a hitch plate (18A) with a joint (18B) configured to receive and retain a hitch screw (18C) arranged in the dragging clamp (16), FIG. 13.

The invention claimed is:

1. A self-closing device for sliding doors, said doors having at least one sliding leaf which is hung from an upper profile and configured to be displaced in a direction thereof, said device comprising:

a drive belt configured to be arranged along the upper profile and configured to be joined to the sliding leaf;

a closing pulley, provided with pre-loaded biasing means for imparting a rotational force on the closing pulley, the closing pulley rotating on a first rotation axis configured to be integral to the upper profile and driven by a first end of the drive belt, wherein said pulley loads the biasing means during opening of the sliding leaf through rotation movement transmitted by the drive belt; and wherein said closing pulley pushes the sliding leaf during closing of the sliding door through opposite rotation movement that transmits unloading of the biasing means; and;

a brake pulley, provided with stopping means, which is arranged on a second rotation axis configured to be integral to the upper profile and which engages a second end of the drive belt opposite to the first end, the rotation movement of the closing pulley and the brake pulley being connected by the drive belt, wherein said brake pulley disengages the stopping means during the opening of the sliding leaf; and stops the sliding leaf during the closing of the sliding door by a clutch of the stopping means;

a friction brake drum joined to a stop body by first fastening means; and a brake shaft joined to the second rotation axis and producing friction against the brake drum during the closing of the sliding door.

2. The self-closing device for sliding doors according to claim 1, wherein the drive belt is joined to a connection skid integral to a traction clamp that fastens the sliding leaf, wherein said traction clamp comprises rolling means configured to be displaced on a rolling rail arranged along the upper profile.

3. The self-closing device for sliding doors according to claim 1, wherein the closing pulley further comprises:

a closing body, joined to the first rotation axis by a first bearing having an inner housing configured to house the biasing means; and a closing cap, joined to the first rotation axis through a second bearing having second fastening means to the closing body to contain the biasing means.

4. The self-closing device for sliding doors according to claim 3, wherein the closing pulley comprises a pair of washers arranged between the biasing means, within the inner housing, wherein said washers contain axial efforts caused by said biasing means.

5. The self-closing device for sliding doors according to claim 3, wherein the closing body comprises a first toothed perimeter configured to engage with the drive belt.

6. The self-closing device for sliding doors according to claim 5, wherein the stop body comprises a second toothed perimeter configured to engage with the drive belt.

7. The self-closing device for sliding doors according to claim 3, wherein the biasing means comprise a leaf spring featuring an inner end joined to the first rotation axis and an outer end joined to the closing body, wherein said leaf spring is compressed during the opening of the sliding leaf and decompressed during the closing of the sliding door.

8. The self-closing device for sliding doors according to claim 3, wherein the brake pulley further comprises:

a third bearing joining the stop body to the second rotation axis and having an inner housing configured to house the stopping means; and a brake cap having third fastening means to the stop body to contain the stopping means.

9. The self-closing device for sliding doors according to claim 8, wherein the stopping means comprise:

a unidirectional bearing joining the brake shaft to the second rotation axis, which is freely coupled to the brake drum, wherein said unidirectional bearing is configured to:

allow rotation movement of the brake shaft during the opening of the sliding leaf, so that said second rotation axis rotates at the same speed and in the same direction as the brake drum, preventing friction between the brake shaft and the brake drum; and block the rotation movement of the brake shaft in the opposite direction during the closing of the sliding leaf, so that said second rotation axis does not move and produces friction against the brake drum.

10. The self-closing device for sliding doors according to claim 9, wherein the stopping means comprise a friction adjuster coupled to the brake drum, which is configured to control a level of friction between the brake shaft and the brake drum.

* * * * *